US005685236A

United States Patent [19]

Lechman

[11] Patent Number: 5,685,236

[45] Date of Patent: Nov. 11, 1997

[54] ADJUSTABLE MONITOR SUPPORT

[75] Inventor: John N. Lechman, Effingham, Ill.

[73] Assignee: Nova Solutions, Inc., Effingham, Ill.

[21] Appl. No.: 428,860

[22] Filed: Apr. 25, 1995

Related U.S. Application Data

[63] Continuation-in-part of Ser. No. 135,103, Oct. 12, 1993, Pat. No. 5,408,939, which is a continuation-in-part of Ser. No. 24,196, Feb. 26, 1993, Pat. No. 5,290,099.

[51] Int. Cl.[6] ..... A67B 9/00

[52] U.S. Cl. ..... 108/110; 211/208; 211/181

[58] Field of Search ..... 108/107, 110, 108/109; 312/194; 211/181, 198, 208, 187, 192

[56] References Cited

U.S. PATENT DOCUMENTS 3,435,958 4/1969 Chesley ..... 108/107

*Primary Examiner*—Peter M. Cuomo
*Assistant Examiner*—Gerald A. Anderson
*Attorney, Agent, or Firm*—Olson & Hierl, Ltd.

[57] ABSTRACT

A combination structure is disclosed wherein a stand-alone desk structure coacts with an underdesk monitor support structure for positioning and supporting the monitor support. Optionally a slidable keyboard tray support can be included with this monitor support. The top platform member of the desk structure includes a transparent portion. The monitor support structure includes a monitor support shelf and a pair of side supports which are each equipped with a U-configured unitary frame having a pair of legs and a cross member. A plurality of transversely extending, vertically spaced load bearable wire members extend between each pair of legs. Adjustable connector assemblies connect the shelf member with selected load bearable members of each side support. Optionally but preferably, each side support can also include a cross transverse bar which is optionally configured to support a drawer slide in combination with an associated respective leg member. Thus, the monitor support structure can not only support a horizontally slidable keyboard tray, but also be fastened to the underside of the top platform member. The combination of the monitor support structure and stand-alone desk with windowed top platform member provides a useful work station.

2 Claims, 2 Drawing Sheets

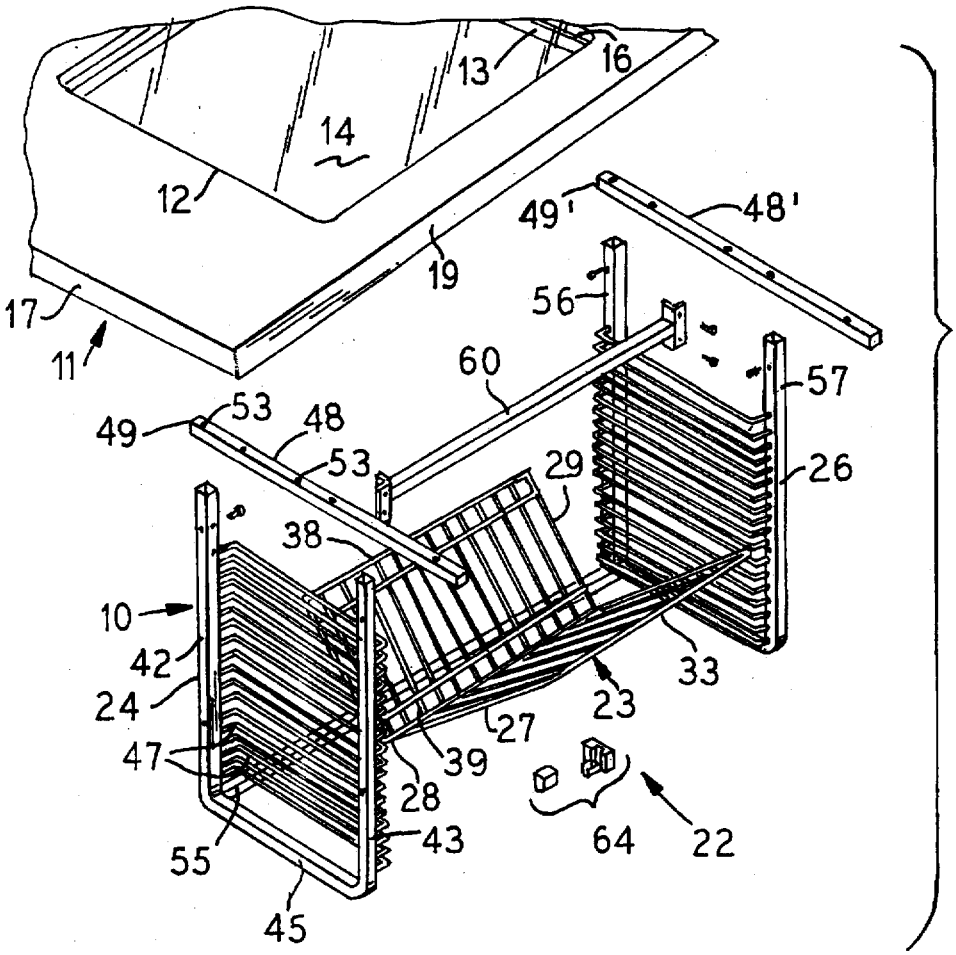
FIG. 1
FIG. 2
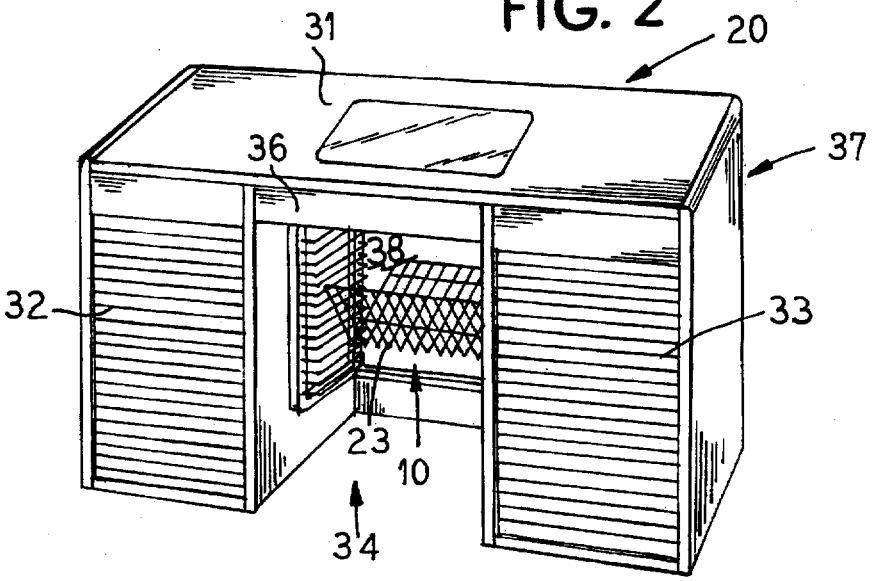

FIG. 3
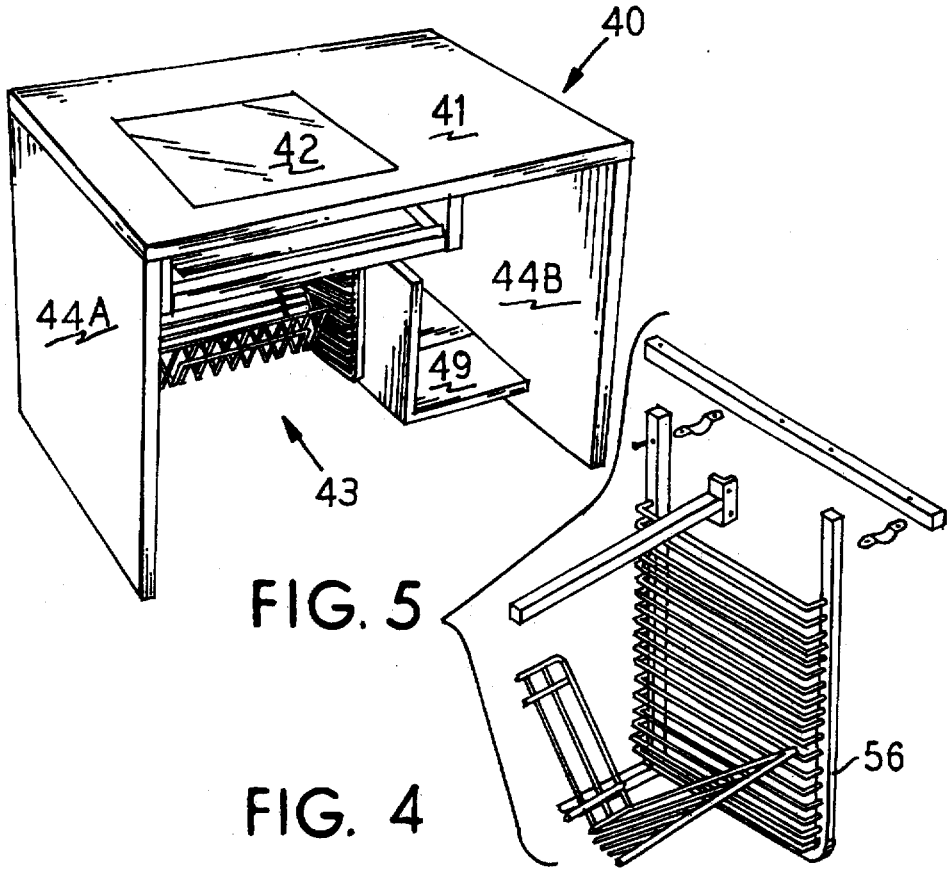
FIG. 5
FIG. 4
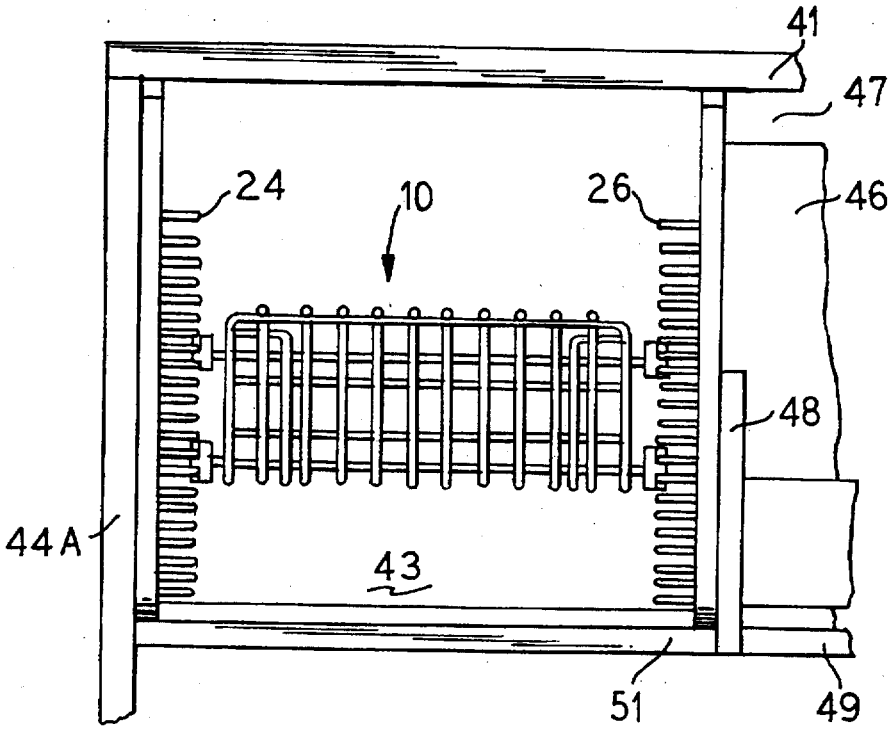

ADJUSTABLE MONITOR SUPPORT

RELATED APPLICATION

This application is a continuation-in-part of U.S. patent application Ser. No. 135,103 filed Oct. 12, 1993, now U.S. Pat. No. 5,408,939 issued Apr. 25, 1995, which is a continuation-in-part of U.S. patent application Ser. No. 024,196 filed Feb. 26, 1993, now U.S. Pat. No. 5,290,099 issued Mar. 1, 1994.

FIELD OF THE INVENTION

This invention relates to an improved adjustable monitor support assembly for use in combination with a stand-alone desk or the like which includes a transparent portion through which a supported monitor can be viewed.

BACKGROUND OF THE INVENTION

A new and very useful type of adjustable underdesk monitor support assembly for a desk structure, computer work station structure or the like is provided in Lechman et al., U.S. Pat. No. 5,125,727 (issued Jun. 30, 1992), which permits a monitor so supported to be viewable through a transparent portion in the structure working platform. This type of monitor support assembly is well suited not only for use in free standing desks, computer work stations, and the like, but also for use in work stations that are incorporated into a modular environment (see, for example, Lechman et al., U.S. Ser. No. 778,333 filed Oct. 17, 1991, now U.S. Pat. No. 5,294,193 issued Mar. 15, 1994).

In a modular environment, wall and even floor surfaces of cubicle defining members are associatable where practical with functional furniture components. A common objective in a modular structure is to provide a maximized usable working area (volumetrically and also surface-area wise).

The modular desk structure provided in the aforementioned U.S. Ser. No. 778,333, now U.S. Pat. No. 5,294,193, requires that the associated monitor support structure be cooperatively engaged with side, back and bottom members that are a part of a desk structure.

For reasons of cost efficiency and improved space utilization, it has been found that an improved adjustable monitor support structure is needed which avoids the need for associated desk members along side, back and bottom portions. Such a monitor support structure is provided in the aforementioned Lechman, Ser. No. 024,196 (now U.S. Pat. No. 5,290,099).

However, the prior monitor support structures, though certainly very useful, have been found not to satisfy the market demand for a versatile self-configuring, geometrically stable combination of monitor support structure and slidable keyboard support tray which can either be suspended from the undersurface of a desk or work station horizontal working surface (for supported monitor screen user viewing through a window in this undersurface), or be floor supported beneath the window for the viewing of the screen.

According to the present invention, the monitor support structure of Ser. No. 024,196 (now U.S. Pat. No. 5,290,099), is altered and changed to provide a new monitor support structure that meets the foregoing market demand. Also, according to the present invention, the monitor support structure of Ser. No. 135,103 (now U.S. Pat. No. 5,408,939) is somewhat simplified and is used in combination with a stand-alone type desk structure.

SUMMARY OF THE INVENTION

One aspect of the present invention relates to an improved adjustable monitor support assembly for association with a stand-alone kneehole type desk structure, whereby a monitor can be supported by this associated monitor support assembly in the desk kneehole for user viewability through a transparent portion of the desk working surface located over the desk kneehole.

In another aspect, the present invention provides a stable combination structure comprised of a stand-alone desk structure having a windowed working surface and an improved adjustable monitor support which may optionally also include a slidable keyboard tray support.

This combination structure is adapted for use in a variety of environmental applications. Thus, for example, this combination structure can involve a single or double pedestal desk structure which is adapted to function as a free standing work station.

In one useful arrangement, such a combination structure is associated with a back modesty panel and/or side upright panel members, if desired, or the like, thereby to stabilize further the combination structure against tipping, sliding or the like.

A particularly significant and useful feature of this combination structure is that the adjustable monitor support does not need to be floor engaging. Thus, even the side supports of the monitor support can terminate in vertically spaced relationship to the underlying floor surface.

Another particularly significant and useful feature of this combination structure is that it can function in the manner of a conventional stand-alone desk structure that is floor supported. The adjustable monitor support can be supported within and by the adjacent portions of the desk structure. Legs or equivalent portions of the desk structure support the combination structure. Typically, the adjustable monitor support is located generally within the kneehole cavity of such a desk structure.

A monitor that is held by the combination structure can be viewed through the transparent window portion of the platform member or working surface of the desk structure; for example, by a worker (or user) who is seated adjacent to the front edge of the top platform member with his or her knees located beneath the platform member. The platform member itself can have various configurations.

The inventive combination structure is simple, reliable and sturdy. Side, back, or bottom desk components can be associated with such combination, if desired. Advantageously, this combination structure can be widely used not only in newly constructed free-standing desk and work station structures, but also in retrofit applications involving existing desk structures, if desired.

The combination support assembly has a monitor supporting shelf member that is adjustably supported at each lateral side of the shelf member by a different one of a pair of side supports. Each side support incorporates a U-configured frame with a pair of opposing side legs with a bottom located, integrally formed, leg interconnecting base cross member that is adapted to be in vertically spaced relationship to an underlying floor surface. A plurality of vertically spaced cross supports interconnect between the side legs of each U-configured frame. The upper end regions of the legs of each U-configured frame are preferably provided with an interconnecting cross bar. Each cross bar can be directly associated by conventional fastening means to the undersurface of a top platform member, desk or the like, and each U-configured frame can be directly associated by conventional fastening means to interior wall surface portions of a stand-alone desk structure.

Optionally, the monitor support structure can be additionally provided with a keyboard-supporting tray which is slidably horizontally movable from a storage position under a top platform member to an extended position projecting outwardly from the front edge of the platform member. This tray is supported by slides that are associated with each of the interconnecting cross bars of the monitor supports structure.

The present invention can thus achieve a work station structure that comprises in combination a stand-alone desk structure whose top platform member incorporates a transparent portion or window, and a monitor support structure that incorporates a pair of U-configured leg brackets. The combination preferably includes a slidable keyboard supporting tray. This work station structure is well adapted for use in an office environment, in a modular working area, in an office cubicle having adjacent wall regions that are defined by modular wall panels, or the like.

The combination structure provides a safe, effective, and efficient unitary combination.

The combination of stand-alone desk and monitor support structure with optional slidable keyboard support tray is easy to assemble from a kit, or the like. If desired, the assembled combination structure can be subsequently easily disassembled, relocated for use elsewhere, and reassembled.

The combination of stand-alone desk and monitor support with optional slidable keyboard support structure is bottom supported by the stand-alone desk whose window equipped flat top platform member provides a maximal working surface area for a worker. The combination is well suited for use in various types of use environments.

Other and further objects, aims, features, purposes, advantages, modifications, embodiments and the like will be apparent to those skilled in the art from the teachings of the present specification taken with the appended drawings and associated claims.

BRIEF DESCRIPTION OF THE DRAWINGS

In the drawings:

FIG. 1 is an exploded perspective view of one embodiment of a monitor support structure of this inventions (shown with a working surface for illustration purposes);

FIG. 2 is a perspective view of an embodiment of a combination structure of this invention wherein a double pedestal stand-alone kneehole type desk structure is associated with the monitor support structure of FIG. 1;

FIG. 3 is a perspective view of another embodiment of a combination structure of this invention wherein the monitor support structure of FIG. 3 is associated with a stand-alone kneehole type desk structure of the type having an exterior end support wall and a transverse interior partial wall to each of which the monitor support structure is fastenable;

FIG. 4 is a fragmentary front elevational view of the combination structure of FIG. 3; and FIG. 5 is a fragmentary view of one side support as shown in FIG. 1 but showing an alternative construction therefor.

DETAILED DESCRIPTION

Referring to FIGS. 1 through 4, there is seen an embodiment of a monitor support structure 10 of the present invention. The monitor support structure 10 is illustratively shown in supportable association with a top platform member 11 that is itself associatable with a known stand-alone kneehole type of desk structure 12. Top platform member 11 is preferably rectangular or square configured, and generally horizontally extending.

The top platform member 11 is conveniently and conventionally formed, for example, of a preferably thickened, dimensionally stable material, such as wood or wood based material, filled plastic, honeycomb molded plastic, formed sheet metal, surface sheet laminated over a porous core in board-like form, a combination of materials, or the like. Use of wood or wood based or filled materials is presently preferred, such as plywood, particle board, fiber board, and the like, and a top platform member 11 so comprised of such a material is preferably conventionally laminated on its respective opposed outer faces to a layer comprised of a melamine polymer or the like. Exposed edge portions are preferably also similarly covered by such a laminate layer.

Top platform member 11 has an aperture 12 formed therein which preferably has appropriately beveled sides that are adapted to support and hold edge portions of a fitted transparent plate member 14 that is formed of clear glass or clear plastic (such as a polyacrylic resin or the like). Preferably, and as shown (see FIG. 4, for example, in the parent application Ser. No. 08/135,103, new U.S. Pat. No. 5,408,939), the lower portion of the side walls defining the aperture 12 are provided with an inwardly projecting flange 13 so that bottom edge adjacent portions peripherally about the transparent member 14 can rest upon a horizontal flat upper shoulder 16 of flange 13 with the upper portion of the sides of aperture 12 being perpendicular relative to shoulder 16. Aperture 12 is conveniently centrally formed in top platform member 11 relative to the lateral opposed side edge 17 thereof, and is conveniently nearer to the front edge 19 thereof than to the back edge (not shown) thereof. Aperture 12 and plate member 14 are preferably generally square or rectangular in perimeter configuration and are preferably substantially larger in surface area than the surface area of the desired monitor screen (not shown) that is to be supported by monitor support 10 and also viewed through plate member 14. Aperture 12 is located over a kneehole 22 of a conventional kneehole type desk (not detailed in FIG. 1).

The monitor support assembly 10 incorporates a shelf member 23 upon which a monitor (not shown) can rest and a pair of side supports 24 and 26 which support the shelf member 23. The shelf member 23 has a flattened bottom support member 27 and, at an adjoining rear shelf edge 28, a flattened back support member 29 that integrally upstands or extends preferably perpendicularly from the edge 28.

The shelf member 23 can have various structures, but it is preferred that the shelf member 23 have an open grill or mesh-like structure so as to enhance heat dissipation from a monitor when in use. Suitable materials of construction for the shelf member 23 include sheet metal with vent holes, perforated sheet metal, expanded sheet metal, combinations of welded sheet metal with wire, wire with interwelded crossover locations, vented reinforced plastic, such as polyester platforms, and the like.

The shelf member 23 is, and as shown, preferably comprised of formed heavy wire members which are welded together at points of contact therebetween. Thus, shelf member 23 incorporates a perimeter defining wire 33 which is folded (bent) upwards at the rear shelf edge 28, and, at each opposed lateral upper back end edge 31 and 32, respectively, is also folded laterally inwardly (in opposed relationship) so as to provide added strength for the back member 29 by using two coplanar lengths of the wire 33 extending along each lateral opposed side edge 34 and 36 of shelf member 23. The interior lengths of wire 33 in back 29 extend from edges 31 and 32 downwardly around edge 28. Back member 29 is further provided in this embodiment with a pair of vertically spaced, parallel, longitudinally extending back member supporting wires 37 and also with a pair of vertically spaced, parallel, longitudinally extending shelf supporting wires 38 and 39.

The opposed respective ends and of each of wire 38 and wire 39 extend somewhat beyond the respective side edges 34 and 36 thereby to provide support stub shafts which extend laterally longitudinally outwardly from the back member 29 in respective opposed relationship to one another. The wire 38 is preferably adjacent to the upper back edges 31 and 32 and the wire 39 is preferably adjacent to the edge 28. Other locations for shelf supporting wires can be used, as those skilled in the art will appreciate, such as locations associated with the bottom support member 27, or with each of the bottom support member 27 and the back support member 29, or otherwise.

The space between the lateral side edges 34 and 36 in the region of the bottom support member 27 is supported by a plurality of laterally spaced, parallel, transversely extending bottom member support wires 41 which in the region of rear edge 28 are bent upwards and welded to at least one of the wires 37, or 39, thereby to aid in providing rigidity and support when the bottom member 27 is cantilevered from the back member 29 as the back member 29 is supported by stub shaft portions of wires 38 and 39.

The respective side supports 24 and 26 each extend vertically the full distance from contacting engagement with the adjacent portions of the underface of the top platform member 11 to a supporting floor surface (not shown).

Each side support 24 and 26 is similar to the other, except that support 26 is turned 180 degrees relative to support 24. The structure of support 24 is representative also of that of support 26. Support 24 incorporates a generally U-configured unitary frame 50 having a cross member 45 and a pair of transversely spaced, vertically extending leg members 42 and 43 that each upwardly extend from opposite ends of the cross member. The length of each leg 42 and 43 is equal to the other and this length extends from the floor to the undersurface of the platform 11. A plurality of vertically spaced transversely extending load bearing members 42 each comprised of heavy wire or the like are provided. Each member 47 includes fastening means, such as butt weldments or the like, mounting each of its opposite end portions to a different one of the leg members. Each frame 50 is preferably cross-sectionally square and tubular.

Support 26 is similarly structured to support 24 and is provided with a cross member 45' and with vertically extending leg members 56 and 57.

The entire mid-region of side support 42 is thus preferably provided with a plurality of vertically equally spaced, parallel, horizontally oriented C-shaped heavy wires 47 with the butt weldments at each of their respective ends being located at the mid-region of a corresponding side face of each of legs 42 and 43. After the welding, which produces a ladder-like arrangement for the wires 47 relative to the legs 42 and 43, the wires 47 are preferably dipped or otherwise treated to coat each wire 47 with an electrically insulative, elastomeric polymeric coating, such as a vinyl plastisol or the like. Support 26 is similarly provided with wires 47'.

The shelf member 23 is adjustably connected to, and supported by, the side supports 24 and 26 by any convenient means. However, it is presently much preferred to associate each of the ends of the respective wires 38 and 39 with an adjacent pair of the wires 47 and 47' of the side supports 24 and 26, respectively, using a locking block assembly 64, such as is described in the aforereferenced U.S. Pat. No. 5,125,725.

Interiorly and across the top end of each leg 42 and 43, a nut (not shown) is secured by welding or the like. A cross bar 48 which is preferably cross-sectionally square and tubular like the frame 50 is laid across each of the top ends of the legs 42 and 43. Preferably (and as shown) the rear end 49 of the bar 48 is coincident with the back side of rear leg 42, and the forward end 51 of the bar 48 extends forwardly beyond the front leg 43 to a location which is preferably approximately just short of the anticipated forward edge 19 of the platform 11. At a location 52 that is in transversely rearwardly spaced relation to forward end 51 along the bar 48, the bar 48 is bent downwardly. The angle of this bend at location 52 can vary, but is typically and preferably in the range of about 25 degrees to about 50 degrees with a bend angle of about 30 degrees being presently most preferred. The bar 48 is provided with transverse bores 53 that are aligned with the upper end of each of the legs 42 and 43 so that screws 54 (preferably flat headed and mountable so as to be flush with the upper side of bar 48) can be threadably engaged through the bores 53 with the nuts in the top ends of legs 42 and 43, thereby to mount the bar 48 to each of the legs 42 and 43. Bar 48' of support 26 is similar to bar 48 and corresponding parts and features are similarly numbered, but with the addition of prime marks thereto, for identification purposes.

To join and hold the side supports 24 and 26 in a desired fixed laterally spaced relationship relative to one another, a horizontally oriented brace or cross support 55 is preferably provided. Conveniently and preferably, brace 55 has a cross-sectionally square configuration like that of frame 50. Brace 55 is positioned in spaced, adjacent relationship to the underlying floor. Brace 55 preferably extends between the cross member 45 of side support 24 and the cross member 45' of side support 26. To achieve an abutting relationship between cross member 45 and adjacent portions of the brace 55 the opposite ends of brace 55 are provided with a vertical terminal plate 58 by welding or the like. Preferably, each plate 58 is angled, so that, through bores therethrough, each plate 58 is mounted to the adjacent cross members 45 and 45' by two screws 60 threadably engaged through mating tapped holes in each plate 58.

Preferably, a second brace 60 that is similar to brace 55 in structure is also provided. Brace 60 preferably extends between rear leg 42 of support 24 and rear leg 56 of support 26 above the top most respective wires 47 and 47'.

Platform 11 is laid over the bars 48 and 48' of the respective side supports 24 and 26 and is fastened thereto by any convenient means. Conveniently and preferably screws (not shown) are extended vertically through bores (not detailed) in bars 48 and 48' respectively and are received in threaded engagement with the underside of platform 11.

The forward ends 51 and 51' of each crossbar 48 and 48' optionally can be downturned as shown and described in the aforereferenced U.S. Pat. No. 5,408,939 to provide a forward mounting location for the forward end of each respective one of a pair of conventional fixed drawer slides (not shown). However, here such forward ends are eliminated. Screws (not detailed) that extend through bores in the crossbars 48 and 48' threadably engage with threaded mating holes in the undersurface of top platform member 11 to complete the mounting of side supports 24 and 26 in laterally spaced parallel relationship to one another relative to top platform member 11. As will also be appreciated from subsequent disclosure herein, various fastening means can be employed to connect a monitor support structure with a stand-alone kneehole type desk structure.

Referring to FIG. 2, there is seen one embodiment of a combination structure 37 of this invention, wherein a stand-alone kneehole type of twin pedestal desk structure 20 has associated therewith in the kneehole region 34 thereof a monitor support structure 10. By the term "stand-alone" as used herein conventional reference is had to a desk-type structure, wherein a generally horizontal work surface is independently supported without need for axially or adjacent support means in spaced relationship to a floor (or ground) surface. By the term "kneehole" reference herein is to a space for the knees under a desk. The term "kneehole desk" or "kneehole-type desk" is used herein attributively to refer to a desk having a kneehole defined under the flat working surface portion thereof.

Desk structure 20 is of the generally known twin pedestal-type (see Lechman et al., U.S. Pat. No. 5,125,727), wherein a top flat surface member 31 is supported by a pair of longitudinally spaced pedestals 32 and 33 which, in combination with top member 31, define therebetween a kneehole 34. Under the surface member 31 across the kneehole 34, is a transversely short keyboard holding platform 36 (not detailed) that is built with desk structure 20 and is transversely slidable from the closed position shown to a fully extended position (not shown). A CPU (central processing unit) (not shown) can be housed within either pedestal 32 or 33. A monitor (not shown) can be positioned or shelf member 23 and functionally associated with a CPU and with a keyboard (not shown), supported on platform 36.

In combination structure 37, the monitor support structure 10 is supported from top member 29 by means of screws (not shown) or the like. In addition, the respective side supports 24 and 26 can be fastened similarly to the adjacent inside end wall of each pedestal 32 and 33. Further, adjacent portions of each side support 24 and 26 can also be similarly fastened to the inside of the back wall 38 of desk structure 20.

In the combination structure 37, the shelf member 23 is adjustable relative to the side supports 24 and 26, as above described herein, and as described in U.S. Pat. No. 5,408,939, for purposes of adjusting viewability of a monitor (not shown) on shelf member 23 for purposes of a desired position of monitor screen viewability by a user (not shown) who is seated at desk 20 with his knees and lower legs and feet normally located in kneehole (without interference from monitor support structure 10).

The top 31 is provided with a transparent member 14 in the same general manner as above described for top platform member 11 and transparent member 14.

While various structures for the tray 36 can be employed, a presently preferred structure is shown and described in copending U.S. Pat. No. 5,205,631 issued Apr. 27, 1993 (the relevant disclosure of which is incorporated herein by reference).

The fastening means for associating a monitor support structure with desk structure 20 can be conventional (such as brackets, screws, or the like, as desired). The combination structure 37 comprised of monitor support structure 10 and desk structure 20 is suitable for use as a work station in many different environments, such as in an environment where the central processing unit (CPU, not shown), that is connected with a monitor (not shown) that is supported by the shelf member 23 and also the keyboard (not shown) supported by the tray 68 by wire and cable means (not shown), is remotely situated relative to the work station 37, and where a printer (not shown) is similarly remotely situated and associated.

The monitor support structure 10 is suitable for association with a desk structure 20 that is preformed and that is being retrofitted with a top surface portion that includes a transparent window and with a monitor support structure of this invention for supporting a monitor beneath the window. As those skilled in the art will readily appreciate, in such an application, the monitor support structure of this invention can employed either without the bars 48 and 48', or with transversely shortened versions of the bars 48 and 48', whichever is preferred, as when the desk involved is already provided with a slidable tray that is to be used for keyboard support. The monitor support structure 10 is particularly advantageous and well suited for association with a desk structure 20 wherein each opposite outside corner is provided with an adjustable foot (not shown) whereby desk height can be adjusted for leveling or for height adjustment. Leg height adjustment is thereby simply and readily achieved by changing the stem position of an adjustable foot relative to the leg bottom.

The cross members 45 and 45' are each associated with its adjacent leg bracket 76 and 77 by fastening means, such as screws 86 which are threadably received in the cross members 45 and 45' through bores 87 preformed in the bases 82 and 83.

The monitor support structure 10 is well suited for association with most known stand-alone, kneehole type desk structures whether or not such structure incorporates pedestals. For example, referring to FIGS. 3 and 4, there is seen a stand-alone, kneehole type desk structure 40 wherein the top platform member 41 (which can be, if desired, structurally similar to member 11) is provided with a transparent window 42 that is situated over the desk kneehole 43.

Desk 40 is supported at each of its longitudinally opposed ends by an end wall 44 (paired) which walls 44 are rigidified by a back wall 46 that is downwardly spaced from platform member 41 to provide an air circulation space or slot 47. Desk 40 is provided with an interior lower partial partition and bracing wall 48 which depends from top platform 41 and which is joined depends from top platform 41 and which is joined to back wall 46. Conventional fastening means are employed in desk 40. Wall 48 defines the inside wall of kneehole 43 and is joined to and supports the inside edge of a shelf member 49. The outside edge of storage shelf member 49 is joined to and is supported by end wall 44B (see FIG. 3). A transversely shallow bracing shelf 51 extends horizontally between lower edge of wall 48 and end wall 43B adjacent to back wall 46 and is connected thereto.

Monitor support 10 is joined to desk structure 46 and is positioned in kneehole 43. The side support 24 is fastened to platform member 41 and end wall 43A. The side support 26 is fastened to wall 48 and to platform member 41. The bottom 45 and 45' of the U-shaped perimeter of each side support 24 ad 26 (see U.S. Pat. No. 5,408,939 rests on shelf member 51. The shelf member 23 is then adjustably connected between side supports 24 and 26 as above-described.

As will be apparent from the foregoing description, the monitor support structure 10 can be variously effectively and usefully joined to a stand-alone, kneehole equipped desk structure. The monitor support structure can be suspended from the top platform member only. Alternatively, the monitor support structure can be joined between a pair of wall portions (back or side) of such a desk structure where each member of such a pair either extends in a different plane or each member is in spaced relationship to the other. For reasons of structural integrity, it is preferred to avoid cantilever-type connections where only one side support 24 or 26 is fastened, or where only a top corner of each such side support is fastened, to such a chosen desk structure. Various fastening and supporting locations can be employed for the support and connection of a monitor support.

Variations in the structure of monitor support structure are certainly possible without departing from the spirit and scope thereof. Referring, for example to FIG. 5, there is seen an arrangement where the respective ends of each U-shaped wire member 47' are first welded to side locations along an interconnecting and vertically oriented (in the assembled condition) wire member 56. Wire member 56 is subsequently then welded to each U-shaped bracket 42'. FIG. 5 also illustrates the use of U-shaped mounting brackets 57 for fastening the side supports.

Various other embodiments, applications, features, alternative but equivalent structures and the like will be apparent to those skilled in the art from this description of the present invention and no undue limitations are to be drawn therefrom.

What is claimed is:

1. An adjustable support assembly for positioning and supporting a monitor under a transparent portion in a working platform comprising:

(a) a shelf member having a bottom support portion, a back support portion angularly extending from a rear region of said bottom support portion, lateral side portions, and a plurality of support members associated with and extending from said lateral side portions;

(b) a pair of side supports, each one being substantially vertically oriented, disposed in spaced, parallel relationship relative to the other, and located along different respective one of said side portions;

(c) each one of said side supports comprising:

(1) a generally U-configured unitary tubular frame having a cross member and pair of transversely spaced vertically extending leg members that each upwardly extend from opposite ends of said cross member, (2) a plurality of vertically spaced, transversely extending load bearing members, each said load bearing member including fastening means for mounting each respective opposite end portion of each said load bearing member to a different one of said leg members; and (d) independent connector means for adjustably connecting individual ones of said support members selectively to at least one of said load bearing members so that said shelf member is vertically positionable, transversely translatable and tiltably adjustable relative to said side supports.

2. The support assembly of claim 1 which is in functional association with a work station structure, said work station structure comprising in combination:

(a) stand-alone desk structure that comprises:

(1) a generally flat panel at least a portion of which is transparent, (2) means for supporting said panel generally horizontally in vertically spaced relationship to an underlying generally flat floor surface, (3) said means for supporting and said panel defining a kneehole beneath said flat panel, said kneehole being open along and beneath a side edge portion of said flat panel; and means for fastening each one of said side supports to said desk structure in said kneehole so that said side supports are in longitudinally spaced, parallel relationship to each other; whereby said shelf member is adjustably connectable with said side supports by said independent connector means.

* * * * *